US005927693A

United States Patent [19]

Hackl

[11] Patent Number: 5,927,693

[45] Date of Patent: Jul. 27, 1999

[54] ROPE GUIDING DEVICE WITH PIVOTAL GUIDE ROLLER FOR ROPE WINCHES

[76] Inventor: Leopold Hackl, A-3300 Amstetten, Friedmuhl, Austria, 200a

[21] Appl. No.: 08/959,227

[22] Filed: Oct. 28, 1997

[51] Int. Cl.[6] ..... B66D 3/08

[52] U.S. Cl. ..... 254/398; 254/390; 254/394; 254/326; 254/327; 254/335; 254/338

[58] Field of Search ..... 254/323, 325, 254/326, 327, 390, 335, 338, 394, 398; 414/538

[56] References Cited

U.S. PATENT DOCUMENTS

| | | | |
|---|---|---|---|
| 736,472 | 8/1903 | Anderson . | |
| 1,092,714 | 4/1914 | Holmes | 254/397 |
| 1,435,065 | 11/1922 | Holmes | 414/563 |
| 2,336,684 | 12/1943 | Hendrickson | 242/157 |
| 2,387,245 | 10/1945 | Davidson et al. | 254/190 |
| 2,473,628 | 6/1949 | Allison | 254/190 |
| 2,660,382 | 11/1953 | Wilson | 242/158 |
| 2,744,696 | 5/1956 | Overton et al. | 242/157 |
| 2,815,927 | 12/1957 | Howard | 254/335 |
| 3,652,029 | 3/1972 | Stewart | 242/157.1 |
| 3,708,152 | 1/1973 | Bulin | 254/190 R |
| 3,716,217 | 2/1973 | Watabe | 254/139.1 |
| 3,794,296 | 2/1974 | Hasstedt | 254/8 B |
| 3,843,093 | 10/1974 | Thompson et al. | 254/139.1 |
| 3,982,733 | 9/1976 | Orme | 254/173 R |
| 3,984,085 | 10/1976 | Bexten | 254/190.2 |
| 4,226,405 | 10/1980 | Roodt | 254/335 |
| 4,515,329 | 5/1985 | Sandvik | 242/157.1 |
| 4,518,126 | 5/1985 | Marshall | 242/18 R |
| 4,620,693 | 11/1986 | Vialars et al. | 254/335 |
| 4,740,132 | 4/1988 | Peyre | 414/494 |
| 4,778,121 | 10/1988 | Minnee | 242/157.1 |
| 5,593,139 | 1/1997 | Julian | 254/325 |

FOREIGN PATENT DOCUMENTS

| | | | |
|---|---|---|---|
| 367534 | 10/1906 | France | 254/327 |
| 2410819 | 3/1974 | Germany . | |
| 2419406 | 4/1974 | Germany . | |
| 2360397 | 1/1975 | Germany | 254/327 |
| 3531326 C1 | 9/1985 | Germany . | |
| 779312 | 7/1957 | United Kingdom | 254/338 |
| 824178 | 11/1959 | United Kingdom | 254/338 |

*Primary Examiner*—Donald P. Walsh
*Assistant Examiner*—Minh-Chau Pham
*Attorney, Agent, or Firm*—Sidley & Austin

[57] ABSTRACT

A rope guiding device (1) for rope winches (W) comprises a stand with points of attachment for the attachment of a rope winch, which stand accommodates a rope guide (3) constituting the rope outlet and inlet and a guide roller (4) pivotally supported on this rope guide for deflecting the rope between rope winch and rope guide. To achieve a compact, space-saving construction, the stand consists of a rectangular frame (2) with a front leg (21) and two adjoining side legs (25), on whose front leg (21) in the longitudinal central portion the rope guide (3) is arranged, which is aligned transverse to the front leg (21) and parallel to the plane of the frame, and a swivel arm (41) protruding between the side legs (25) is pivotally mounted about a swivel axis (S) normal to the rope guiding direction (F) and to the plane of the frame, which swivel arm (41) carries at its free end the guide roller (4) rotatably mounted about a rotational axis (D) extending transverse to the swivel arm (41) and parallel to the plane of the frame, and on whose side legs (25) the points of attachment (26) for the attachment of the rope winch are seated.

4 Claims, 2 Drawing Sheets

ROPE GUIDING DEVICE WITH PIVOTAL GUIDE ROLLER FOR ROPE WINCHES

TECHNICAL FIELD OF THE INVENTION

This invention relates to a rope guiding device for rope winches, comprising a stand having points of attachment for the attachment of the rope winch, which stand accommodates a stationary rope guide constituting the rope outlet and inlet, and a guide roller pivotally supported on this rope guide for deflecting the rope between rope winch and rope guide.

BACKGROUND OF THE INVENTION

As is for instance disclosed in US-A-2,473,628, the rope guiding devices have so far been fitted with trestle-like stands serving both for the direct support of the rope winch itself and for the support of the guiding means for the winch rope, where for feeding the rope to the winch drum as it is wound, the guide roller is seated on a separate guide block which is movable along a curved guideway extending above the winch drum. The stationary rope guide is anchored at the ground in the center of curvature of the guideway, and should let the rope run in and out in the proper direction independent of the winding position on the winch drum. The known stand, and thus the entire rope guiding device is therefore comparatively complex and requires relatively much space when it is mounted, so that there are often difficulties in the use of the winch, above all in connection with vehicle winches.

SUMMARY OF THE INVENTION

It is therefore the object underlying the invention to eliminate these deficiencies and create a rope guiding device as described above, which is characterized by its compact, space-saving construction and its variety of possible uses.

This object is solved by the invention in that the stand consists of a preferably rectangular frame including a front leg and two adjoining side legs, where on the front leg in the longitudinal central portion the rope guide aligned transverse to the front leg and parallel to the plane of the frame is disposed, and a swivel arm protruding between the side legs is pivotally mounted about a swivel axis normal to the rope guiding direction and to the plane of the frame, which swivel arm carries at its free end the guide roller rotatably mounted about a rotational axis extending transverse to the swivel arm and parallel to the plane of the frame, and on whose side legs the points of attachment are seated. With this frame there is obtained a separate rope guiding unit, so to speak, which can be combined with various rope winches and represents a very simple, flat cassette-like construction. The rope of a rope winch, preferably a commercially available motor winch, which can easily be screwed onto the side legs of the frame, need merely be guided away from the winch drum over the guide roller and through the rope guide, and there are obtained proper rope guiding conditions which are perfect both as regards to the windings on the rope drum and also as regards the possibility for a precise winding and unwinding. Moreover, the frame as such is a rugged and stable component, which will also resist the roughest winch operation.

When the swivelling range of the swivel arm is limited by adjustable limit stops of the side legs, the rope guiding device can easily be adapted to correspondingly different rope winch dimensions and can optimally be used up to the maximum dimension of the rope winches determined by the size of the frame.

There might actually be provided different embodiments of the rope guide, for instance a simple lug or so-called butterfly disks or the like might be used as a rope guide, but it is particularly expedient when the stationary rope guide is incorporated in the vicinity of a recess of the front leg and comprises two smooth roller pairs arranged one behind the other in rope guiding direction and angularly offset with respect to each other by 90°, of which the roller pair on the side of the guide roller has roller axes parallel to the swivel axis of the swivel arm. These roller pairs can perfectly be mounted before and behind the recess of the front leg, and with a corresponding distance of the individual rollers constituting a pair, which distance is adapted to the rope diameter, provide a proper rope guide, which on the one hand compensates the rope defection depending on the swivel arm position towards the guide roller, and on the other hand easily compensates deviations of the rope winding and unwinding means from the rope guiding direction by means of the externally disposed rollers, so that there is obtained a rope guide which satisfies all kinds of demands. There is always maintained the flat construction of the entire rope guiding device, which is predetermined by the frame, and the concept of the guiding unit separate from the actual rope winch.

In accordance with a particularly advantageous embodiment of the invention, a supporting stand comprising an attachment plate for mounting the frame and a coupling means for connection to a trailer coupling of a vehicle is associated to the frame. This simple supporting stand is substantially used as adapter for the frame for the connection of a rope winch on a vehicle, where this supporting stand can be coupled to a usual trailer coupling via the coupling means, for instance to a coupling mouth or a ball-shaped coupling of a vehicle, and then only the frame together with the rope winch must be mounted on the attachment plate, so as to obtain an optimally supported and aligned vehicle winch. For connection to a vehicle coupling with a coupling mouth penetrated by a coupling pin a drawbar attachment with a coupling lug on the attachment plate is sufficient, and for coupling to a ball-shaped coupling the attachment plate is equipped with an abutment housing to be mounted on the ball of the coupling and to be locked by means of a safety pin or the like. When a load is acting on the rope, the substantially loosely coupled supporting stand ensures an alignment determined by the rope guiding device and a tension-resistant support of the rope winch, so that optimum conditions of use are ensured.

BRIEF DESCRIPTION OF THE DRAWINGS

In the drawings, the subject-matter of the invention is illustrated by way of example, wherein.

DETAILED DESCRIPTION OF THE INVENTION

Figure 1:
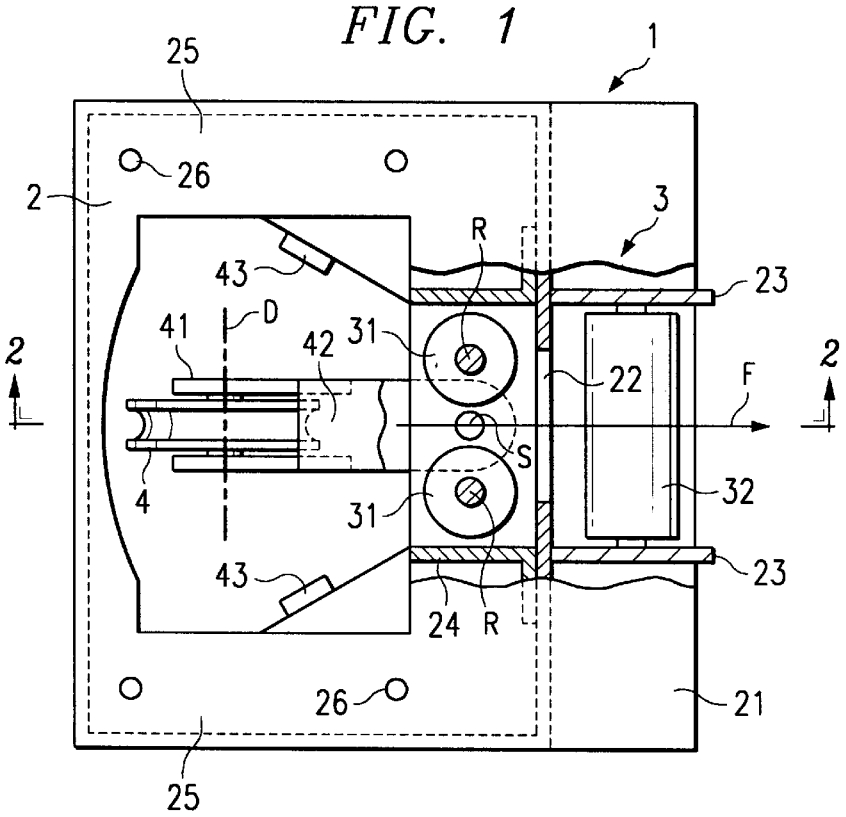
FIG. 1 shows a top view of an inventive rope guiding device in a partial section.
Figure 2:
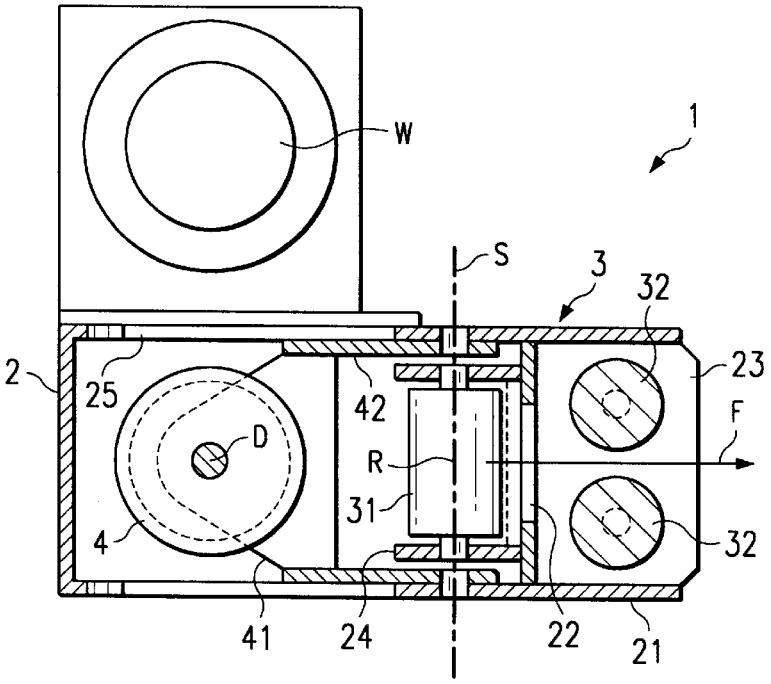
FIG. 2 shows a cross-section along line 11—11 of FIG. 1.

A rope guiding device 1 consists of a cassette-like rectangular frame 2, which accommodates a stationary rope guide 3 constituting the rope inlet and outlet as well as a pivotally supported guide roller 4 for deflecting the rope between the rope winch w and the rope guide 3.

The rope guide 3 is incorporated in the front leg 21 of the frame 2 in the longitudinal central portion thereof with a guiding direction F extending transverse to the front leg 21 and parallel to the plane of the frame, where the front leg 21 constitutes a corresponding guiding recess 22. The rope guide 3 comprises two smooth roller pairs 31, 32 disposed one behind the other in guiding direction F and each angularly offset by 90°, where the roller pair 31 on the side of the guide roller has roller axes R normal to the plane of the frame and extending transverse to the front leg 21. The individual rollers of the roller pairs 31, 32 are spaced from each other corresponding to the rope diameter of the winch rope, so that a proper rope guide is obtained, which perfectly compensates above all deflections of the extension of the rope about the roller axes R. For the assembly of the roller pairs a pair of bearing cheeks 23 is attached at the front leg 21, and the roller pair 31 is screwed to the inside of the front leg 21 by means of a bearing cage 24.

In the longitudinal central portion of the front leg 21 a swivel arm 41 is furthermore pivotally mounted about a swivel axis S normal to the plane of the frame and to the rope guiding direction F, which swivel arm 41 protrudes into the interior of the frame and at its free end carries the guide roller 4 rotatable about a rotational axis D extending parallel to the plane of the frame and transverse to the swivel arm 41. With a fork-shaped bearing attachment 42 the swivel arm 41 engages over the bearing cage 24 of the roller pair 31 and can thus easily be pivoted on the front leg 21, which for instance consists of an I-section. For limiting the swivel range of the swivel arm 41 adjustable stops 43 are provided in the side portion, so that the range of movement of the guide roller 4 can be adapted to different lengths of winch drums.

The frame 2 has side legs 25 laterally connected at the front leg 21, which have points of attachment 26 for the attachment of a rope winch W, which is only indicated. Thus, every suitable rope winch W can easily be attached at the rope guiding device 1, and as a result of the flat, cassette-shaped construction of the rope guiding device a wide field of application is obtained, where the frame can at the same time also be used for supporting the winch on an anchorage or the like, on which it can be fixed directly or indirectly.

Figure 3:
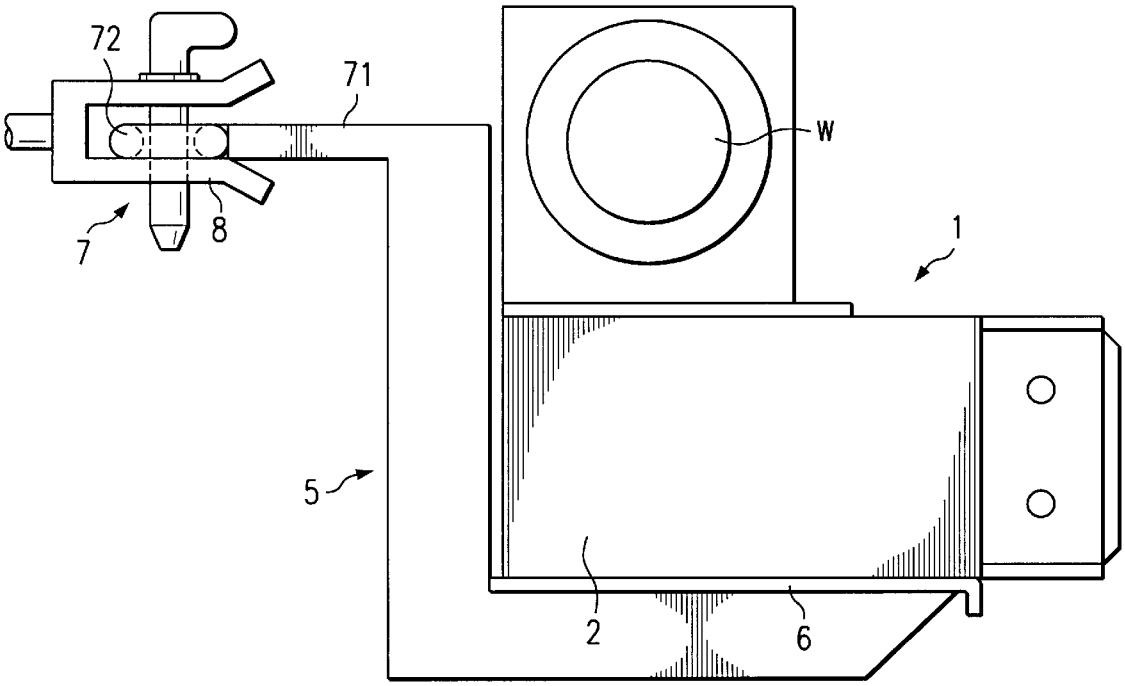
FIG. 3 and FIG. 4 each show a side view of an embodiment of a supporting stand associated to the rope guiding device in a partial section.
Figure 4:
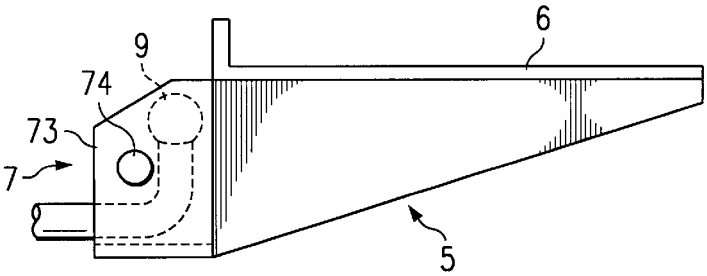

One of the preferred applications lies in the field of vehicle winches, for which purpose a supporting stand 5 is associated to the frame 2, as is indicated in FIGS. 3 and 4, which supporting stand has an attachment plate 6 for the attachment of the frame, and a coupling means 7 for connection to a trailer coupling of a vehicle. This coupling means 7 can consist of a trailer lug 72 moulded on an angular supporting arm 71, with which lug the supporting stand 5 can be coupled to a usual trailer coupling 8 through which extends a coupling pin (FIG. 3). However, the coupling means 7 can also be a simple abutment housing 73 with a safety pin 74, with which the supporting stand 5 can be mounted on a ball pin 9 of a ball-shaped coupling and be locked (Fig. 4). The supporting stands 5 can thus quickly and easily be coupled to all kinds of vehicles, and immediately provide for the proper use of rope winch W mounted on the attachment plate 6 by means of the frame 2.

I claim:

1. A rope guiding device for rope winches, comprising a stand having points of attachment for the attachment of a rope winch, which stand accommodates a stationary rope guide constituting the rope outlet and inlet, and a guide roller pivotally mounted about this rope guide for deflecting the rope between rope winch and rope guide, characterized in that the stand consists of a rectangular frame (2) having a plane and including a front leg (21) and two adjoining side legs (25), where on the front leg (21) in the longitudinal central portion the rope guide (3) aligned transverse to the front leg (21) and parallel to the plane of the frame is disposed, and a swivel arm (41) protruding between the side legs (25) is pivotally mounted about a swivel axis (S) normal to the rope guiding direction (F) and the plane of the frame, which swivel arm (41) carries at its free end the guide roller (4) rotatably mounted about a rotational axis (D) extending transverse to the swivel arm (41) and parallel to the plane of the frame, and on whose side legs (25) the points of the attachment (26) are seated.

2. The rope guiding device as claimed in claim 1, characterized in that the swivelling range of the swivel arm (41) is limited by adjustable limit stops (43).

3. The rope guiding device as claimed in claim 1, characterized in that the stationary rope guide (3) is incorporated in the vicinity of a recess (22) of the front leg (21) and comprises two roller pairs (31, 32) arranged one behind the other in rope guiding direction (F) and angularly offset with respect to each other by 90°, of which the roller pair (31) on the side of the guide roller has roller axes (R) parallel to the swivel axis (S) of the swivel arm (41).

4. The rope guiding device as claimed in claim 1, characterized in that a supporting stand (5) with an attachment plate (6) for the attachment of the frame (2) and a coupling means (7) for connection to a trailer coupling (8, 9) of a vehicle is associated to the frame (2).

* * * * *